US007664427B2

(12) United States Patent
Kawasumi et al.

(10) Patent No.: US 7,664,427 B2
(45) Date of Patent: Feb. 16, 2010

(54) IMAGE FORMING APPARATUS WITH LOCKING MEANS

(75) Inventors: Ryoichi Kawasumi, Toride (JP); Takashi Nakanishi, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 11/741,124

(22) Filed: Apr. 27, 2007

(65) Prior Publication Data

US 2007/0286649 A1 Dec. 13, 2007

(30) Foreign Application Priority Data

May 15, 2006 (JP) ..... 2006-135288

(51) Int. Cl.
*G03G 15/00* (2006.01)

(52) U.S. Cl. ..... 399/110

(58) Field of Classification Search ..... 399/110, 399/121

See application file for complete search history.

(56) References Cited

U.S. PATENT DOCUMENTS 6,801,742 B1 10/2004 Mochimaru et al.
7,127,195 B2 * 10/2006 Kimura et al. ..... 399/116
2007/0110476 A1 * 5/2007 Lee et al. ..... 399/121

FOREIGN PATENT DOCUMENTS

JP 2003-287939 10/2003
JP 2004-020691 1/2004
JP 2005345940 A * 12/2005

* cited by examiner

*Primary Examiner*—Quana M Grainger
(74) *Attorney, Agent, or Firm*—Fitzpatrick, Cella, Harper & Scinto

(57) ABSTRACT

The image forming apparatus of this invention comprises: an image bearing member bearing a toner image to be transferred to a recording material; a unit including the image bearing member and capable of being pulled out from an apparatus main body; a transfer member which contacts the image bearing member and transfers the toner image on the image bearing member onto the recording material; an opening/closing member including the transfer member and capable of being opened and closed with respect to the apparatus main body; a first locking means which locks the unit to the apparatus main body; and a second locking means which locks the opening/closing member in a closed state; wherein the second locking means is released in conjunction with the releasing operation of the first locking means.

9 Claims, 18 Drawing Sheets

IMAGE FORMING APPARATUS WITH LOCKING MEANS

BACKGROUND OF THE INVENTION

1. Field of the Invention

The present invention relates to an image forming apparatus such as a copying machine and a printer which forms an image on a recording material.

2. Description of the Related Art

Full color image forming apparatus adopting an electrophotographic type is advancing in recent years. A color image forming apparatus mounted with four or more process cartridges including a photosensitive drum is being widely used.

Such color image forming apparatus adopting an intermediate transfer type is being widely used to reduce the size of the apparatus main body and to eliminate image defects due to the type of recording material such as heavy paper. In such apparatus, the image created with four process cartridges is primary transferred to the intermediate transfer belt, and the toner image is secondary transferred to the recording material at a secondary transfer portion.

Recently, the arrangement of the intermediate transfer belt and the process cartridges widely uses the configuration of first arranging the intermediate transfer belt in the horizontal direction with the conveying direction of the recording material as the longitudinal direction, and arranging four process cartridges in line at the lower surface of the belt. According to such arrangement, the time until the secondary transfer of the toner image created in the primary transfer is reduced, and at the same time, the distance from the process cartridges to the secondary transfer portion is reduced, and in consequence, the printing time can be reduced (Japanese Patent Application Laid-Open No. 2003-287939).

The replacement of an image creating unit including a plurality of process cartridges described above will now be described.

First, a first prior art example is illustrated in FIG. 10. In an image forming apparatus main body 600, an intermediate transfer belt 601 and a transfer frame 602 supporting the intermediate transfer belt 601 are moved in the direction of an arrow R1, that is, upward so that the intermediate transfer belt 601 moves away from the photosensitive drums 604 in the process cartridges 603. The process cartridges 603 are thereafter pulled out in the P1 direction towards the front of the main body to be replaced.

In the above configuration, a pressurizing/pressure releasing mechanism for moving away/contacting the intermediate transfer belt 601 and the transfer frame 602 with respect to the photosensitive drums 604 is required. When detaching the intermediate transfer belt 601, the intermediate transfer belt 601 and the transfer frame 602 supporting the same are moved in the direction of the arrow R1, and a transfer roller or a conveyance roller (not shown) arranged facing the intermediate transfer belt 601 are evacuated in the direction of the arrow R2. The intermediate transfer belt 601 is then pulled out in the P1 direction towards the front of the main body. The damages on the components involved in the pull-out operation are thereby prevented. The pressurizing/pressure releasing mechanism for moving away/contacting the conveyance roller with respect to the intermediate transfer belt 601 is required in such configuration.

The replacing configuration of the intermediate transfer belt 601 and the process cartridges 603 of the prior art example is as follows. Since the pressurizing/pressure releasing mechanism of the conveyance roller with respect to the intermediate transfer belt 601 is required in addition to the pressurizing/pressure releasing mechanism of the intermediate transfer belt 601 with respect to the process cartridges 603, the configuration becomes complicating and the cost increases. Furthermore, such configuration is a disadvantage in terms of the size of the apparatus main body since the evacuation space for the intermediate transfer belt 601 and the evacuation space for the conveyance roller, which are not used other than in time of replacement, are required.

A configuration of contacting/moving away the conveyance roller and the intermediate transfer member by handle operation without arranging a pressure releasing mechanism is disclosed in Japanese Patent Application Laid-Open No. 2004-20691. In the relevant publication, a pull-out lever of the intermediate transfer unit cannot be completely unlocked unless a door 40 arranged at the side of the image forming apparatus is opened, as illustrated in FIG. 11. Such configuration prevents the intermediate transfer member from being pulled out with the conveyance roller and the intermediate transfer member in a contacting state.

However, such configuration requires the user himself/herself to open the side door, which increases the working step, and moreover, requires an unlocking unit 50, which increases the number of components.

SUMMARY OF THE INVENTION

The present invention can reduce the number of components and to enhance the operability of opening/closing a plurality of opening/closing members.

The present invention is to provide an image forming apparatus including:

an image bearing member bearing a toner image to be transferred to a recording material;

a unit including the image bearing member and capable of being pulled out from an apparatus main body;

a transfer member which contacts the image bearing member and transfers the toner image on the image bearing member onto the recording material;

an opening/closing member including the transfer member and capable of being opened and closed with respect to the apparatus main body;

a first locking means which locks the unit to the apparatus main body; and a second locking means which locks the opening/closing member in a closed state; wherein the second locking means is released in conjunction with the releasing operation of the first locking means.

Further features of the present invention will become apparent from the following description of exemplary embodiments with reference to the attached drawings.

DESCRIPTION OF THE EMBODIMENTS

The image forming apparatus according to one embodiment of the present invention will now be specifically described with reference to the drawings.

First Embodiment

FIGS. 1 to 7 illustrate the image forming apparatus according to the first embodiment.

(Entire Configuration of Image Forming Apparatus)

Figure 1:
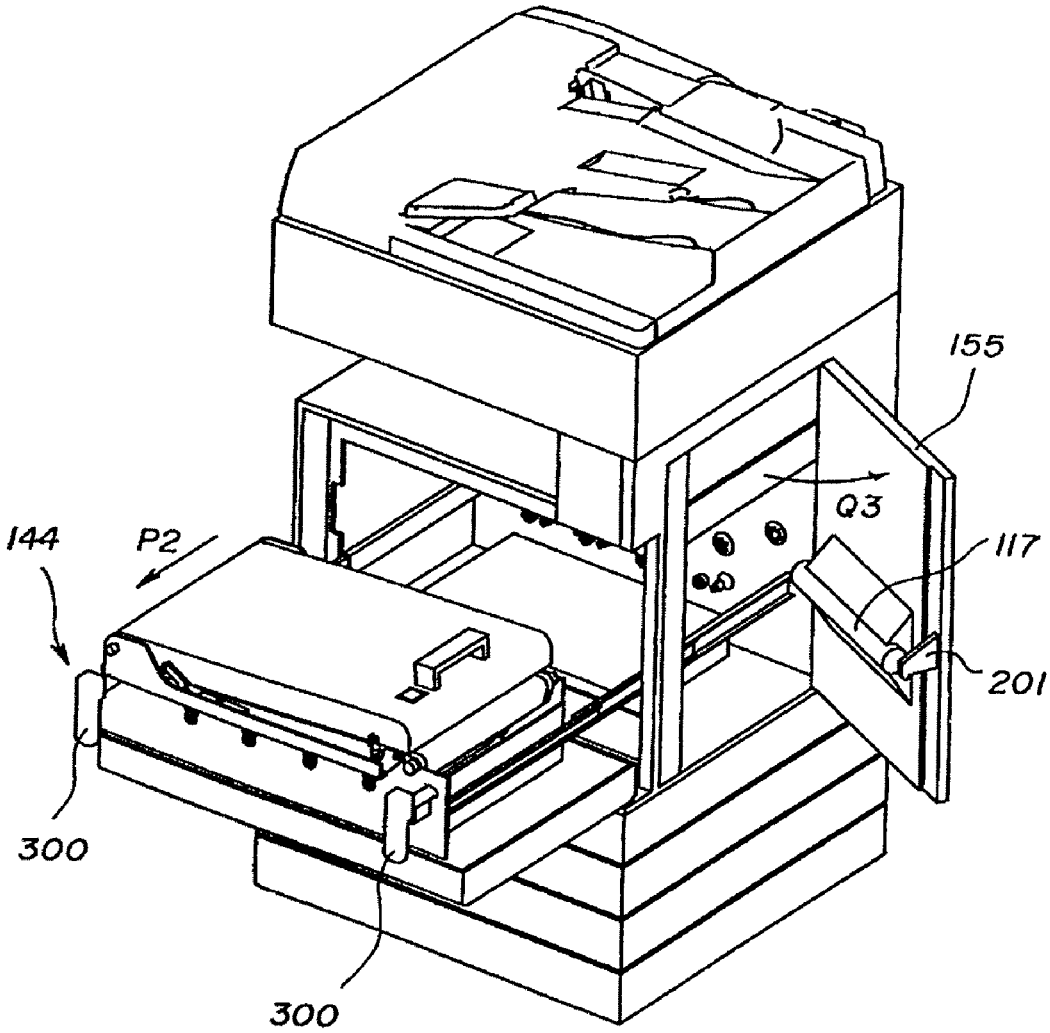
FIG. 1 illustrates a perspective view of an image forming apparatus.
Figure 2:
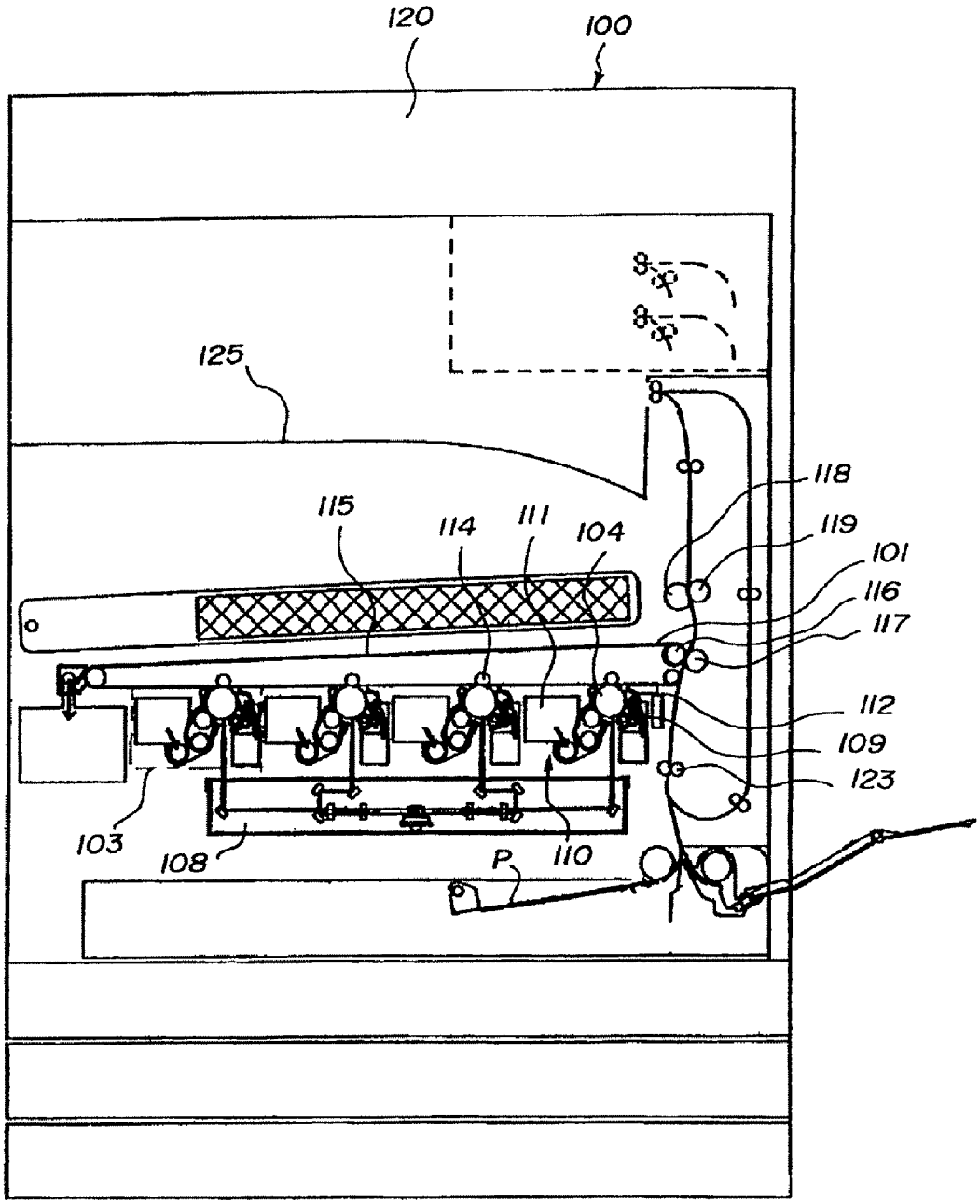
FIG. 2 illustrates a cross sectional view of the image forming apparatus.

First, the entire configuration of the image forming apparatus of the present embodiment will be described along with the image forming operation with reference to FIGS. 1 and 2.

The image forming apparatus of the present embodiment in which four photosensitive drums 104 corresponding to each color of yellow, magenta, cyan, and black are arrayed in a line in the horizontal direction is provided as a full color image forming apparatus of electrophotographic type. The toner image of each color formed on each photosensitive drum 104 is sequentially overlapped on an intermediate transfer belt 101, that is, a second image bearing member arranged above to form a color image. The apparatus is a so-called in-line image forming apparatus that secondary transfers the toner image onto a recording material conveyed in the longitudinal direction. The time until the secondary transfer of the toner image created in the primary transfer can be thereby reduced.

The image forming apparatus 100 includes four process cartridges 103, that is, image forming units arranged in a straight line at a constant interval in a substantially horizontal direction, and each process cartridge forms an image of yellow, magenta, cyan, and black. Each process cartridge 103 is detachably attached with respect to the apparatus main body.

A drum type electrophotographic photosensitive member 104 (photosensitive drum), which serves as a first image bearing member, is arranged in each process cartridge 103. A primary charger 109, a developing unit 110, a toner accommodating portion 111, a drum cleaner device 112, and a primary transfer roller 114 serving as a primary transfer member are arranged around the photosensitive drum 104. A laser exposure device 108 is also arranged on the lower side between the primary charger 109 and the developing unit 110.

Each toner of yellow, cyan, magenta, and black is supplied to each developing unit 110 from the corresponding toner accommodating portion 111 (in order from upstream side in the moving direction of the intermediate transfer belt 101).

An intermediate transfer belt unit 115 includes a drive roller 116 also functioning as an in-secondary transfer roller and is rotatably driven by a drive gear on a main body (not shown). The drive roller 116 is arranged so as to face a secondary transfer roller 117.

In the conveying direction of the recording material P, a fixing device including a fixing roller 118 and a pressure roller 119 is arranged at the downstream side of the secondary transfer roller 117 in a longitudinal path configuration.

The apparatus main body of the present embodiment is divided into a conveying portion that mainly performs conveyance of the recording material and fixation of the toner image, and an image creating portion that mainly performs image forming operation. Of the units described above, the process cartridges 103, the intermediate transfer belt unit 115, and the exposure device are categorized as the image forming portion, and the fixing device is categorized as the conveying portion.

In image formation, an original is read with an original reading device 120, and each photosensitive drum 104 that is rotatably driven when an image forming start signal is issued is uniformly charged by the primary charger 109. An electrostatic latent image of each color is formed on each photosensitive drum 104 when the exposure device 108 performs exposure corresponding to the image signal. The electrostatic latent image is made visible by being developed as the toner image by the developing unit 110, and the toner image is transferred to the intermediate transfer belt 101 through bias application to the primary transfer roller 114.

The primary transfer residual toner remaining on the photosensitive drum 104 is collected by the drum cleaner device 112.

The full color toner image is formed by sequentially overlapping and transferring the toner image of each color of yellow, magenta, cyan, and black formed as above onto the intermediate transfer belt 101. The full color toner image on the intermediate transfer belt 101 is collectively transferred to the recording material P, which is conveyed to the secondary transfer portion on the longitudinal path, by applying bias to the secondary transfer roller 117.

The recording material P transferred with the color image is heated and pressurized by the fixing device positioned on the downstream side so that the toner image is heat fixed on the surface, and thereafter, the recording material P is discharged to a discharge tray 125 on the upper surface of the apparatus main body.

In the image forming apparatus of the present embodiment, a conveyance door 155 serving as an opening/closing member is arranged on the apparatus main body so as to be opened and closed when rotated with the far side of the apparatus main body as the center. In the present example, the opening/closing member is provided to open the side surface of the image forming apparatus and to open the conveyance path of the recording material. One of the registration roller pairs 123 for determining the image transfer timing on the recording material, the secondary transfer roller 117, that is, a transfer member that pressure contacts the intermediate transfer belt 101 and a double-sided path are arranged on the conveyance door 155. Therefore, the intermediate transfer belt 101 and the secondary transfer roller 117 move away from each other as one of the registration roller pairs 123 and the secondary transfer roller 117 integrally move with the conveyance door 155 when the conveyance door 155 is opened from the apparatus main body, thereby facilitating the access to the entire conveying portion. The jam clearance operation ability of when the recording material gets jammed in the middle of the longitudinal path thus becomes satisfactory.

(Frame Body Configuration)

The frame body configuration of the present embodiment will now be described using FIGS. 3 to 6.

Figure 3A:
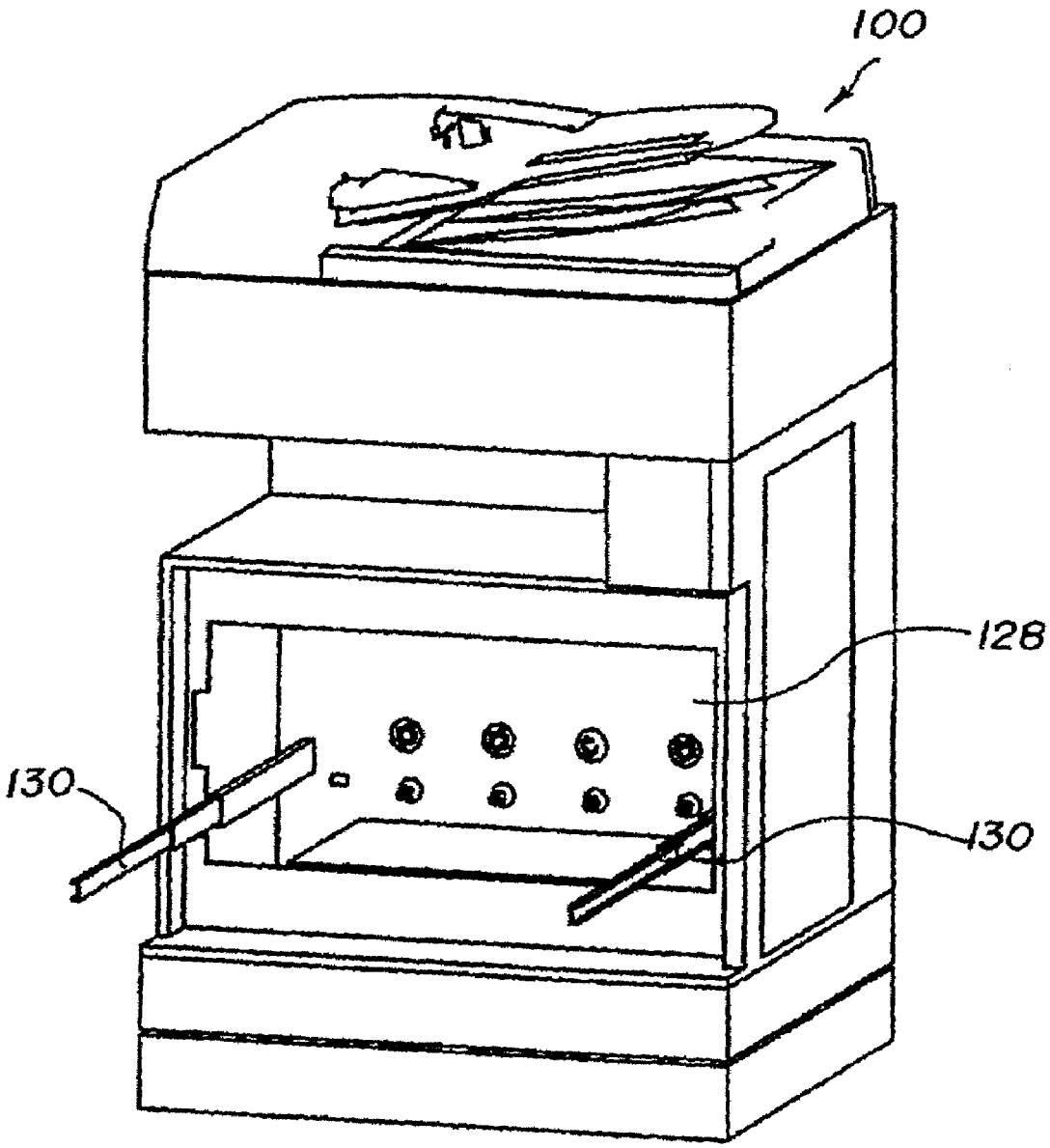
FIG. 3A illustrates a perspective view of a main body case supporting the image forming apparatus main body.
Figure 3B:
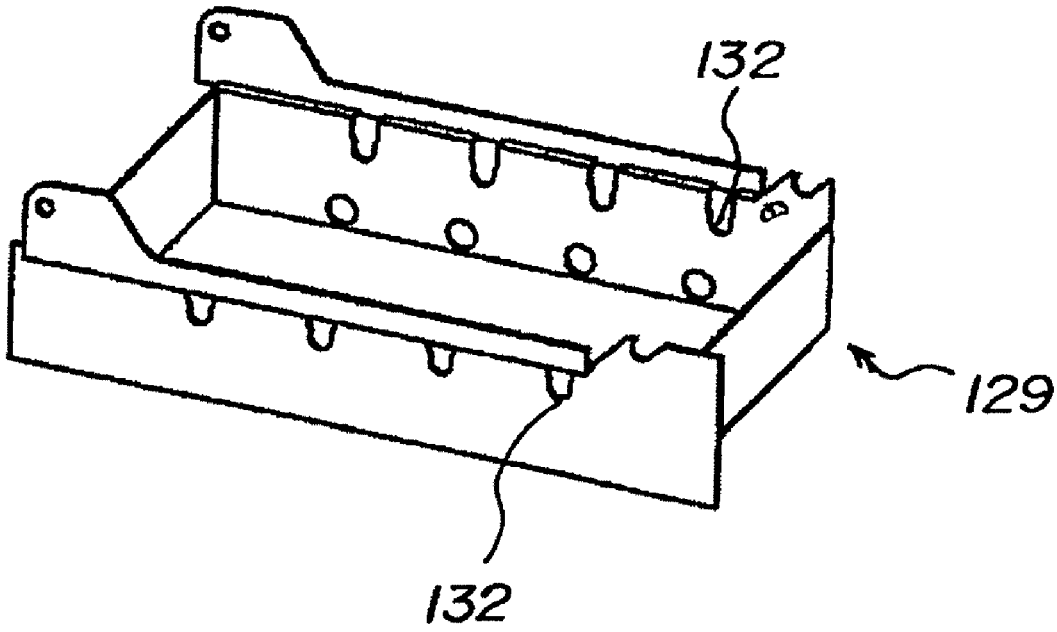
FIG. 3B illustrates a perspective view of an image creating main body case supporting an image creating portion.

FIG. 3A illustrates a main body case 128 which supports the entire image forming apparatus main body, and FIG. 3B illustrates an image creating main body case 129 which supports the image creating portion.

Two extensible supporting rails 130 which supports the image creating main body case 129 when taking out the image creating main body case 129 outside the image forming apparatus 110 is arranged on the left and on the right in the main body case 128.

The image creating main body case 129 is adapted so that four process cartridges 103 can be attached in the main body case. Regarding positioning in time of attachment, bearings (two at both ends) which are not shown supported on a rotating bus axis of the photosensitive drum 104 are fitted to drum supporting portions 132 (two at both ends) illustrated in FIG. 3B to enable high precision positioning with respect to the image creating main body case 129.

The intermediate transfer belt 101 is also adapted so as to be attached to the image creating main body case 129. Regarding positioning in time of attachment of the intermediate transfer belt 101, a bearing 142 supported on the axis of the drive roller 116 for driving the intermediate transfer belt 101 is fitted to a belt supporting portion 143 (see FIG. 5A) arranged in the image creating main body case 129 to enable high precision positioning with respect to the image creating main body case 129.

According to the above positioning configuration, the photosensitive drum 104 and the intermediate transfer belt unit 115 are positioned at high precision by way of the image creating main body case 129.

Figure 4A:
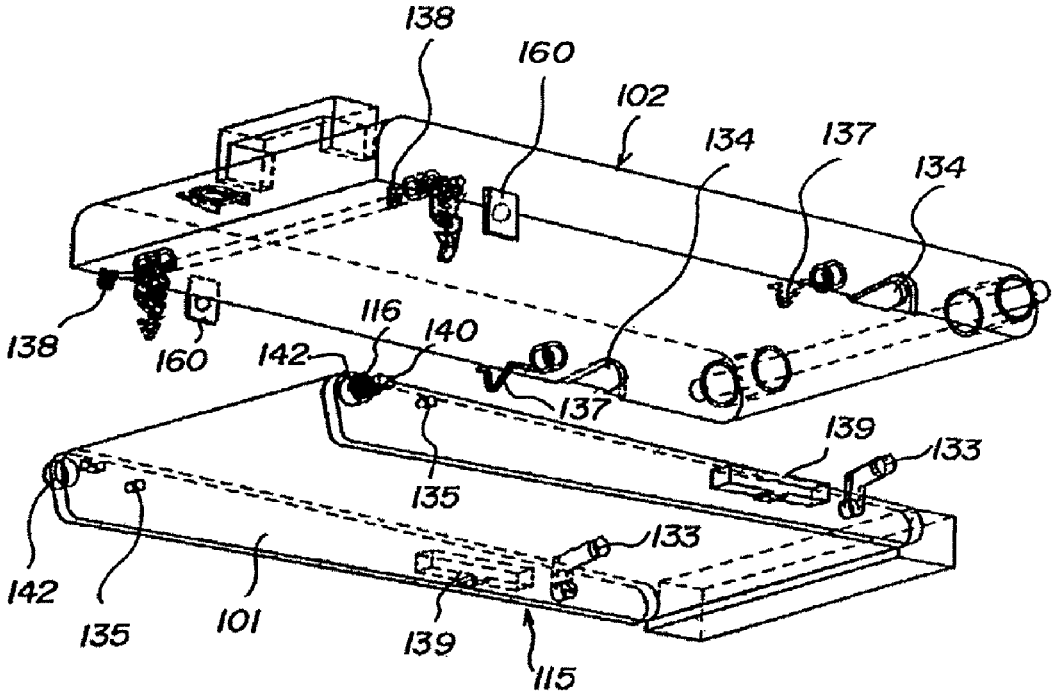
FIG. 4A illustrates an explanatory view of the intermediate transfer belt unit in an exploded state.
Figure 4B:
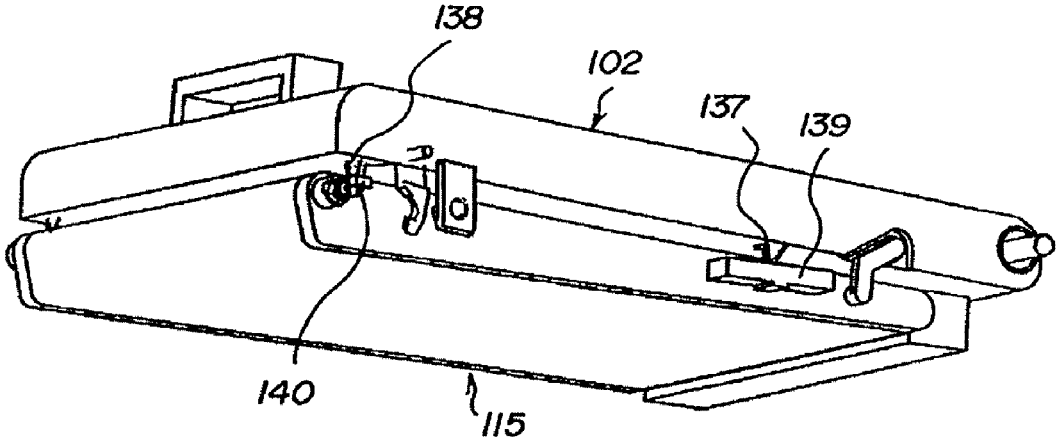
FIG. 4B illustrates an explanatory view of the intermediate transfer belt unit in an assembled state.

FIG. 4A illustrates the intermediate transfer belt unit 115 and the transfer frame 102 in an exploded state. The intermediate transfer belt unit 115 has a configuration such that first holding portions 134 (two) and second holding portions 160 of the transfer frame 102 respectively engage to first engaging portions 133 (two) and second engaging portions 135 (two) of the intermediate transfer belt unit 115. The intermediate transfer belt unit 115 and the transfer frame 102 are thereby assembled as illustrated in FIG. 4B.

In this case, first pressure springs 137 (two) in the transfer frame 102 are hooked while pressurizing first supporting members 139 (two) of the intermediate transfer belt unit 115 downward. Similarly, second pressure springs 138 (two) in the transfer frame 102 are hooked while pressurizing second supporting portions 140 (two) near the drive roller 116 of the intermediate transfer belt unit 115 downward.

Three rollers of the drive roller 116, a tension roller, and an idle roller (not shown) which define the primary transfer surface are arranged in the intermediate transfer belt unit 115. The intermediate transfer belt 101 is stretched between the three rollers.

The intermediate transfer belt 101 is positioned at high precision with respect to the main body case but is not supported by a rigid body. Thus, the intermediate transfer belt 101 is weak against damages and, for example, can be easily displaced by external force in the direction of the rotation axis line of the drive roller 116. Thus, the image forming apparatus of the present embodiment has a configuration of reliably performing pressure release so that defects do not occur by the secondary transfer roller 117, that is, the transfer member pressure contacting the intermediate transfer belt 101 when pulling out the belt to the outside of the apparatus main body such as in replacement, as hereinafter described.

Figure 5A:
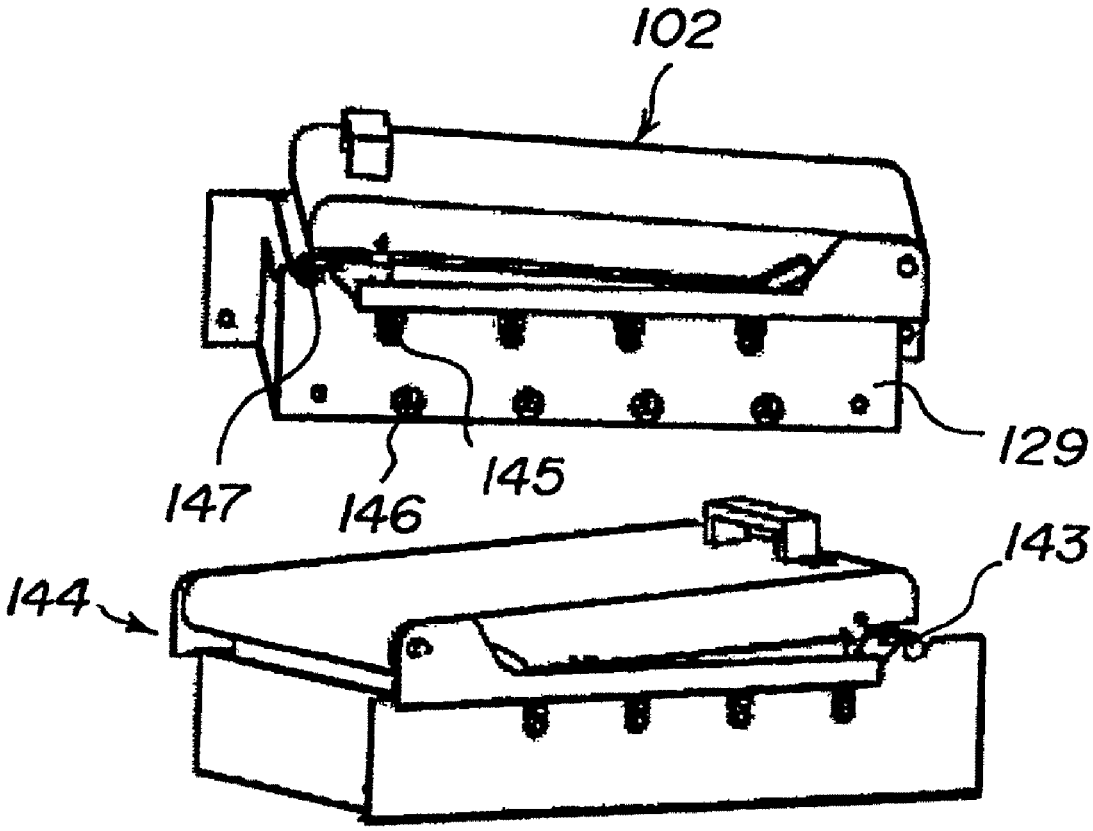
FIG. 5A illustrates an explanatory view of a main body case of the image creating unit.

As illustrated in FIG. 5A, a first drum coupling 145 for driving the photosensitive drum and a first development coupling 146 for driving the developing device are further arranged on the detachably attachable unit side. A first drive roller coupling 147 is further arranged in the drive roller 116 for driving the belt.

Figure 5B:
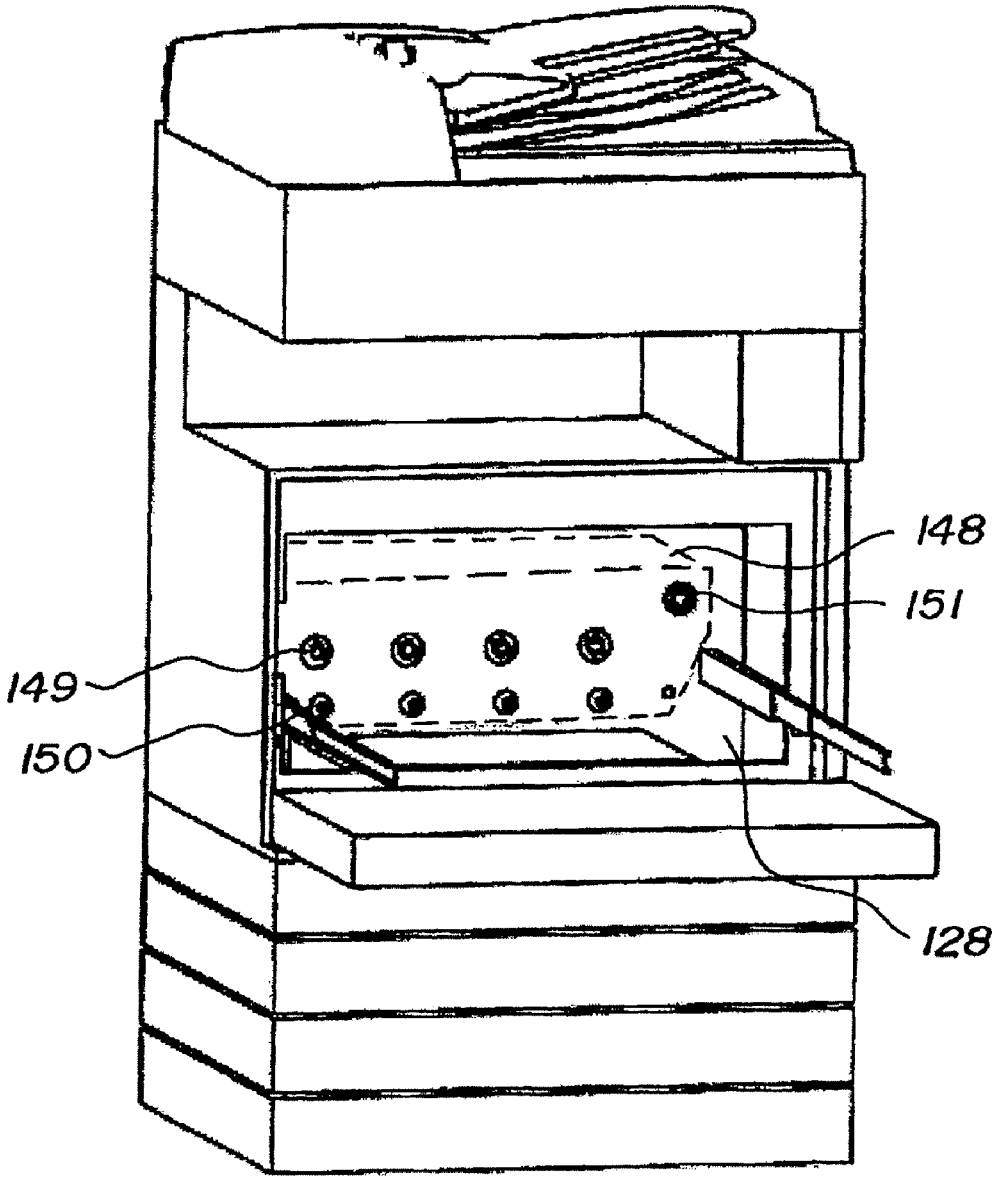
FIG. 5B illustrates an explanatory view of a coupling arrangement of the apparatus main body.

Couplings that couple to each of the above couplings are arranged on the apparatus main body side, as illustrated in FIG. 5B. That is, a second drum coupling 149 that couples with the first drum coupling 145, a second development coupling 150 that couples with the first development coupling 146, and a second drive roller coupling 151 that couples with the first drive roller coupling 147 are arranged on the main body drive 148.

When the process cartridges 103 and the intermediate transfer belt unit 115 are attached, the couplings are coupled, whereby transmission of driving force to the photosensitive drum 104, the developing member, and the drive roller 116 is preformed.

If such drive transmission is not properly performed, image defects such as color drift immediately occur, and thus a design that takes into consideration maintenance property and replacement property of the drive transmitting portion must be carried out.

(Detachment/Attachment of Image Creating Unit)

The detachment/accommodation method of the image creating unit 144 (intermediate transfer belt unit 115, transfer frame 102, process cartridges 103, image creating main body case 129) with respect to the apparatus main body, which is a feature of the present embodiment, will now be described using FIGS. 6 and 7. In the present embodiment, the image creating unit is described as a unit including the second image bearing member by way of example. The image creating unit 144 is slidably attached through the apparatus main body in the front and back direction, that is, in the direction of the rotation axis line of the secondary transfer roller 117 by the supporting rail 130 described above, and is detached by being pulled out from the apparatus main body. The detachment is performed through the following procedures.

Figure 6A:
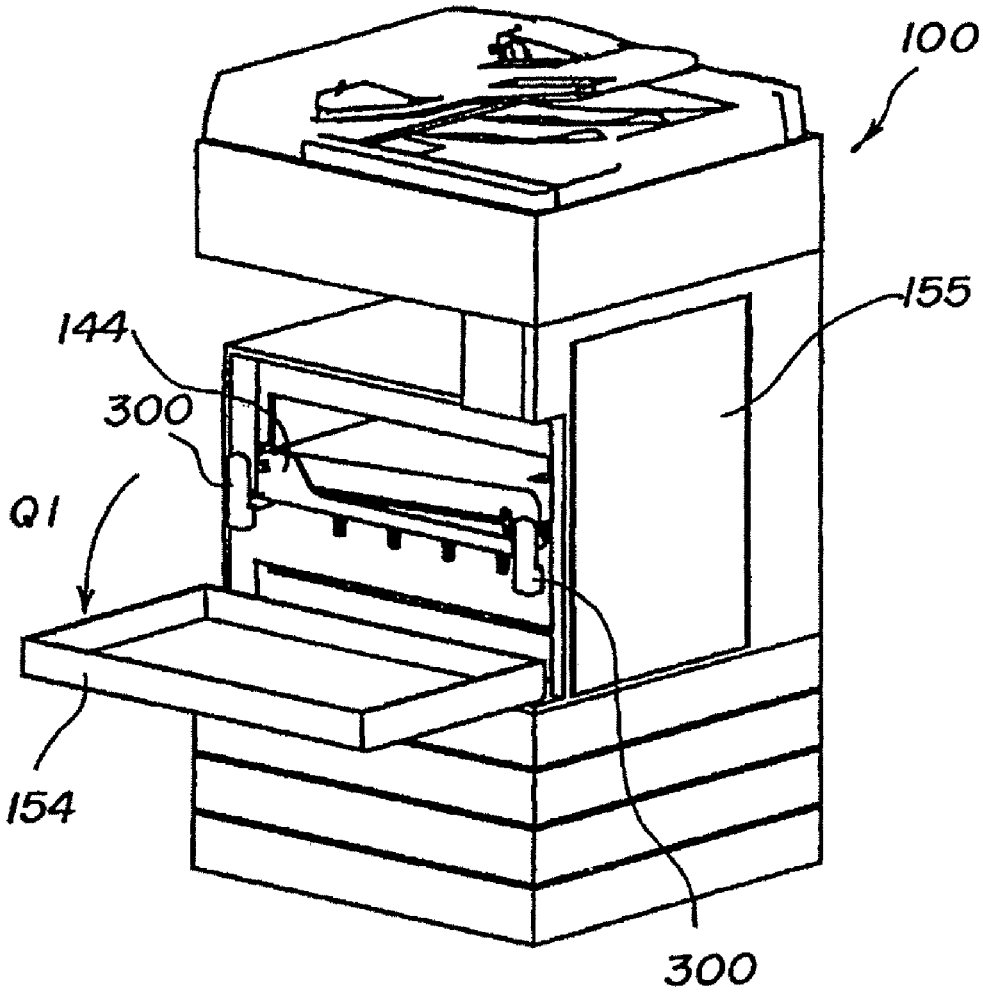
FIG. 6A illustrates an explanatory view of a state in which the front cover is opened when taking out the image creating unit.

(1) The front cover 154 of the image forming apparatus 100 is opened in the direction of an arrow Q1 in FIG. 6A.

Figure 6B:
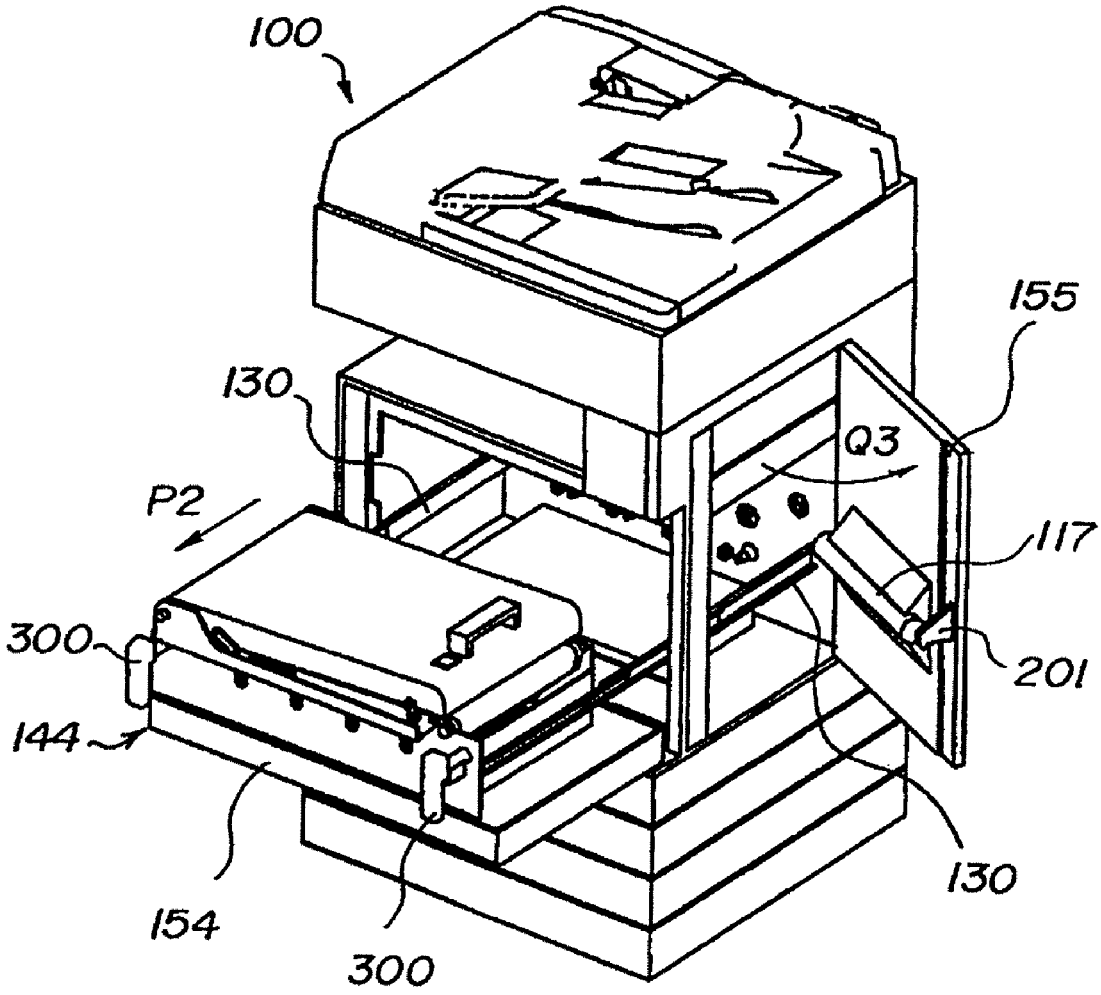
FIG. 6B illustrates an explanatory view of a state in which the image creating unit is pulled out when taking out the image creating unit.

(2) The handle member 300 arranged on both left and right sides at the front surface of the image creating main body case 129 in FIG. 6 is rotated over 180 degrees from a state illustrated in FIG. 6A to a state illustrated in FIG. 6B. The lock for fixing the position of the image creating unit 144, which operates simultaneously with the handle support shaft 301A illustrated in FIG. 7, with respect to the apparatus main body is thereby unlocked. The position of fixing the image creating unit 144 with respect to the apparatus main body is a position of the image creating unit 144 in image formation. The image creating unit is locked while being attached to the apparatus main body when the handle member 300 is at a predetermined position. Such configuration includes a locking portion including an engagement nail at the end of the handle support shaft 301A, where the locking portion engages the engaging portion of the apparatus main body when the handle support shaft 301A is rotated to lock the image creating unit 144.

(3) The conveyance door 155 serving as an opening/closing member including the secondary transfer roller 117 illustrated in FIG. 6B is opened in the direction of an arrow Q3 in conjunction with the operation of rotating the handle member 300 to an unlocking position in the present example. The pressure release of the secondary transfer roller 117 on the intermediate transfer belt 101 is performed when the conveyance door 155 is opened.

(4) The image creating unit 144 is pulled out in the P2 direction towards the front of the apparatus main body, as illustrated in FIG. 6B.

The operation is performed in the reverse procedures to the above procedures when accommodating the image creating unit 144 in the apparatus main body.

(Unlocking/Pressure Releasing Mechanism)

The handle member 300, that is, a first locking means is a movement member which performs rotational movement between a position of opening the lock (FIG. 6A) and a position of unlocking (FIG. 6B) The unit is locked and unlocked with respect to the apparatus main body by changing the position of the handle member 300.

In the image forming apparatus of the present embodiment, the secondary transfer roller 117 pressure contacts the intermediate transfer belt 101 when the conveyance door 155 is closed, and a second locking means is arranged to maintain such state. The second locking means is adapted such that the maintaining state of the conveyance door 155 is released in conjunction with the unlocking operation of the first locking means.

The unlocking by the first locking means on the apparatus main body in procedure (2) and pressure release of the secondary transfer roller 117 on the intermediate transfer belt 101 in procedure (3) will be described below.

Figure 7A:
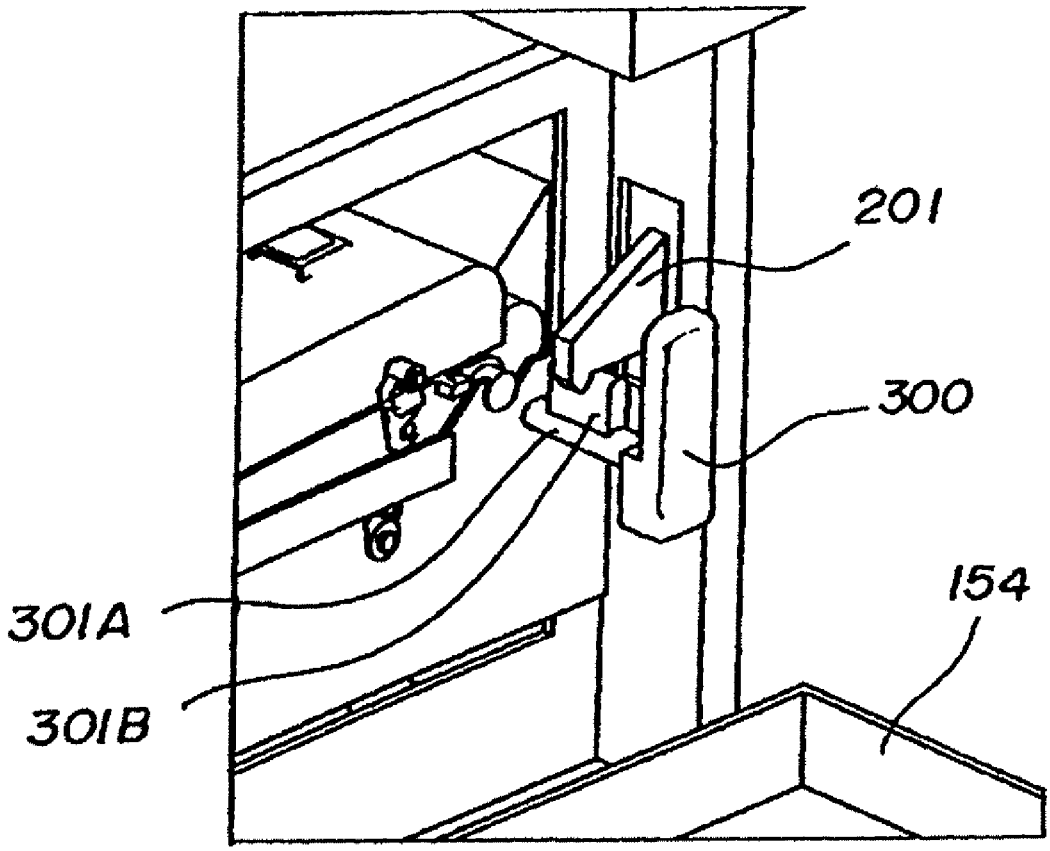
FIG. 7A illustrates an explanatory view of a unit attachment/detachment configuration in the first embodiment.
Figure 7B:
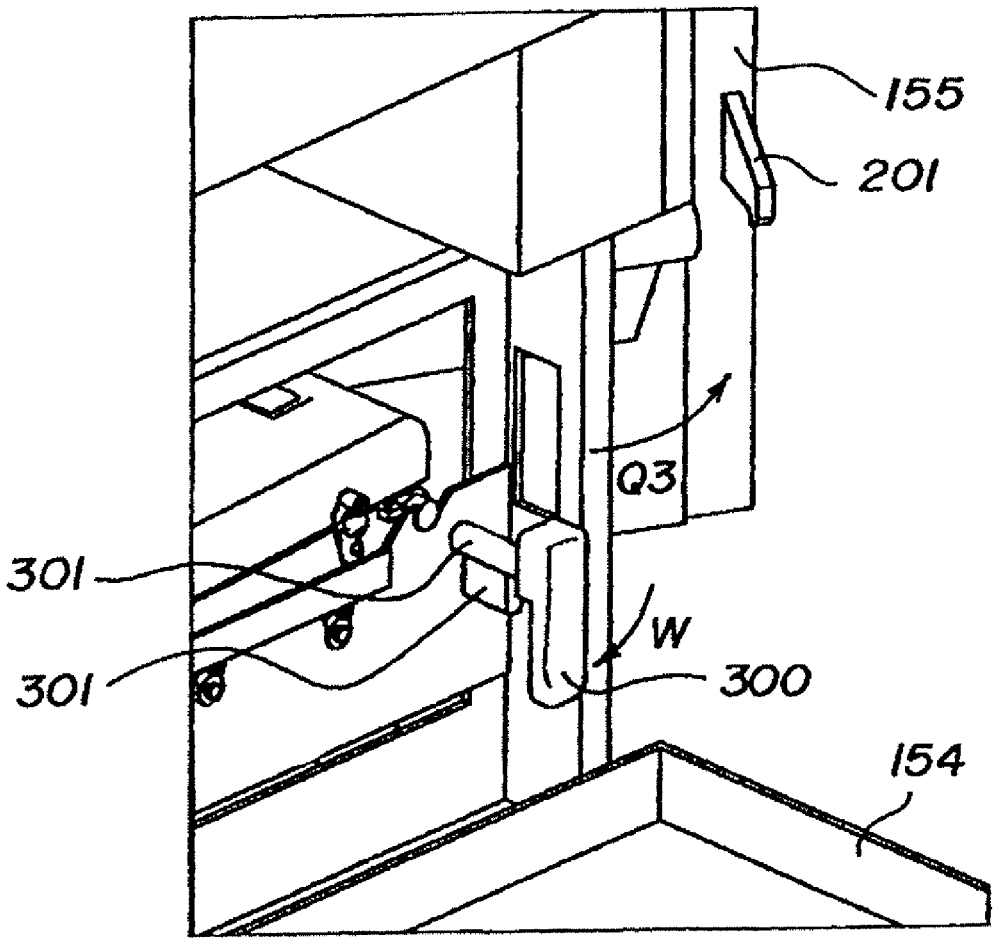
FIG. 7B illustrates an explanatory view of the unit attachment/detachment configuration in the first embodiment.

FIG. 7A illustrates an enlarged view of the vicinity of the handle member 300 arranged on the right side facing the front surface of the apparatus main body. The handle member 300 is rotatably attached to the image creating main body case by the handle supporting shaft 301A, and a conveyance door hook 301B is attached to the handle supporting shaft 301A. The locking portion which locks the attached image creating unit 144 to the apparatus main body is arranged at the end (not shown) of the handle supporting shaft 301A, and such locking portion is unlocked when the handle supporting shaft 301 is rotated with the handle member 300 in the clockwise direction. Furthermore, a latch 201 arranged so as to engage with the conveyance door hook 301B through a square hole formed in the frame of the apparatus main body is arranged at the end of the conveyance door 155.

The latch 201 and the conveyance door hook 301B configure the second locking means. That is, the secondary transfer roller 117 pressure contacts the intermediate transfer belt 101 when the conveyance door is closed. When the latch 201 engages the conveyance door hook 301B in such state, the conveyance door 155 is held in the closed state. This is effective in preventing the forgetting of returning the handle member 300 when forgetting to return the handle member 300 and forgetting to lock in attaching the unit to the image forming apparatus since the conveyance door 155 cannot be held by the second locking means.

The previously described procedures (2) and (3) will be described for the above configuration. First, the handle member 300 is rotated in the clockwise direction in FIG. 7A (direction of arrow W in FIG. 7B) to unlock the image creating unit 144 on the apparatus main body.

Since the conveyance door hook 301B is also rotated in the clockwise direction as the handle member 300 is rotated, the latch 201 on the conveyance door side engaged with the conveyance door hook 301B disengages. The conveyance door 155 rotates in the direction of the arrow Q3 in FIG. 7B through repulsive force by the pressure force of the secondary transfer roller 117 on the intermediate transfer belt. The opening operation of the conveyance door 155 becomes the pressure releasing operation of the intermediate transfer belt 101 and the secondary transfer roller 117 since the secondary transfer roller 117 arranged facing the intermediate transfer belt 101 is arranged on the conveyance door 155.

Unlocking and pressure releasing are performed by turning the handle member 300 in the above manner, and the image creating unit 144 is pulled out while holding the handle member 300. Therefore, the handle member 300 performing the unlocking/pressure releasing operation acts as a handle when sliding the image creating unit 144, so that the image creating unit 144 can be easily taken out.

Therefore, unlocking operation of the image creating unit 144 and the pressure releasing operation of the transfer member on the intermediate transfer belt 101 (procedures (2) and (3)) are simultaneously performed, as described above.

Attaching the image creating unit 144 to the apparatus main body had the possibility of damaging the intermediate transfer belt due to malfunction such as performing the pressure releasing operation of the secondary transfer roller on the intermediate transfer belt unit first before locking the inserted image creating unit in the prior art example. However, in the present embodiment, the conveyance door 155 cannot be hooked unless the image creating unit 144 is accommodated in the apparatus main body, and the handle member 300 is turned to lock the image creating unit 144. That is, the conveyance door 155 is held in the closed state with the image creating unit 144 locked to the apparatus main body. Thus, the above malfunction cannot occur.

Therefore, the unlocking operation of the image creating unit 144 and the pressure releasing operation of the transfer member on the intermediate transfer belt unit 115 are easily and intuitively performed by synchronizing with the operation of pulling out the image creating unit 114 to the outside of the image forming apparatus 100 or accommodating the same. Thus, a configuration in which the drawbacks of malfunction and the like are less likely to occur is obtained.

The possibility of sliding the intermediate transfer belt 101 in the direction of the rotation axis line of the secondary transfer roller 117 while contacting the secondary transfer roller 117 is thus eliminated, and the intermediate transfer belt 101 will not be damaged, for example, the intermediate transfer belt will not be scratched.

Furthermore, access to the drum coupling 145 and the drive roller coupling 147 arranged on the far side of the apparatus main body is extremely easy in a state the image creating unit 144 is pulled out and the conveyance door 155 is opened, as shown in FIG. 6B. The present invention also excels in maintenance property and replacement property since the drive transmitting portion around the couplings is visible even in a state the image creating unit 114 is accommodated in the apparatus main body.

The configuration of FIGS. 6 and 7 is illustrated such that the conveyance door 155 has a rotating center on the far side of the apparatus main body, and rotates in a direction orthogonal to the roller bus in the intermediate transfer belt unit 115. However, the rotating center of the conveyance door 155 is arranged in parallel with the roller bus in the intermediate transfer belt unit 115, and the conveyance door 155 is rotated in the up and down direction with respect to the apparatus main body.

The pressure contact release of the secondary transfer roller 117 on the image creating unit 144 is performed by the opening operation of the conveyance door 155 including the secondary transfer roller 117. Thus, a space does not need to be particularly formed in the apparatus for pressure releasing the secondary transfer roller 117.

Moreover, the access to the drive transmitting portion is facilitated, and advantages of enhancing maintenance property and replacement property are obtained.

Therefore, the detachment and attachment of the unit with the transfer member arranged on the opening/closing member contacting the unit can be eliminated with a small number of components in the present embodiment described above.

Second Embodiment

An image forming apparatus according to the second embodiment will now be described with reference to FIG. 8. The basic configuration of the apparatus of the present embodiment is the same as the embodiment described above, and thus redundant description will not be repeated, and the characteristic configuration of the present embodiment will be described. The same reference numerals are denoted for members having the same function as the above-described embodiment.

Figure 8A:
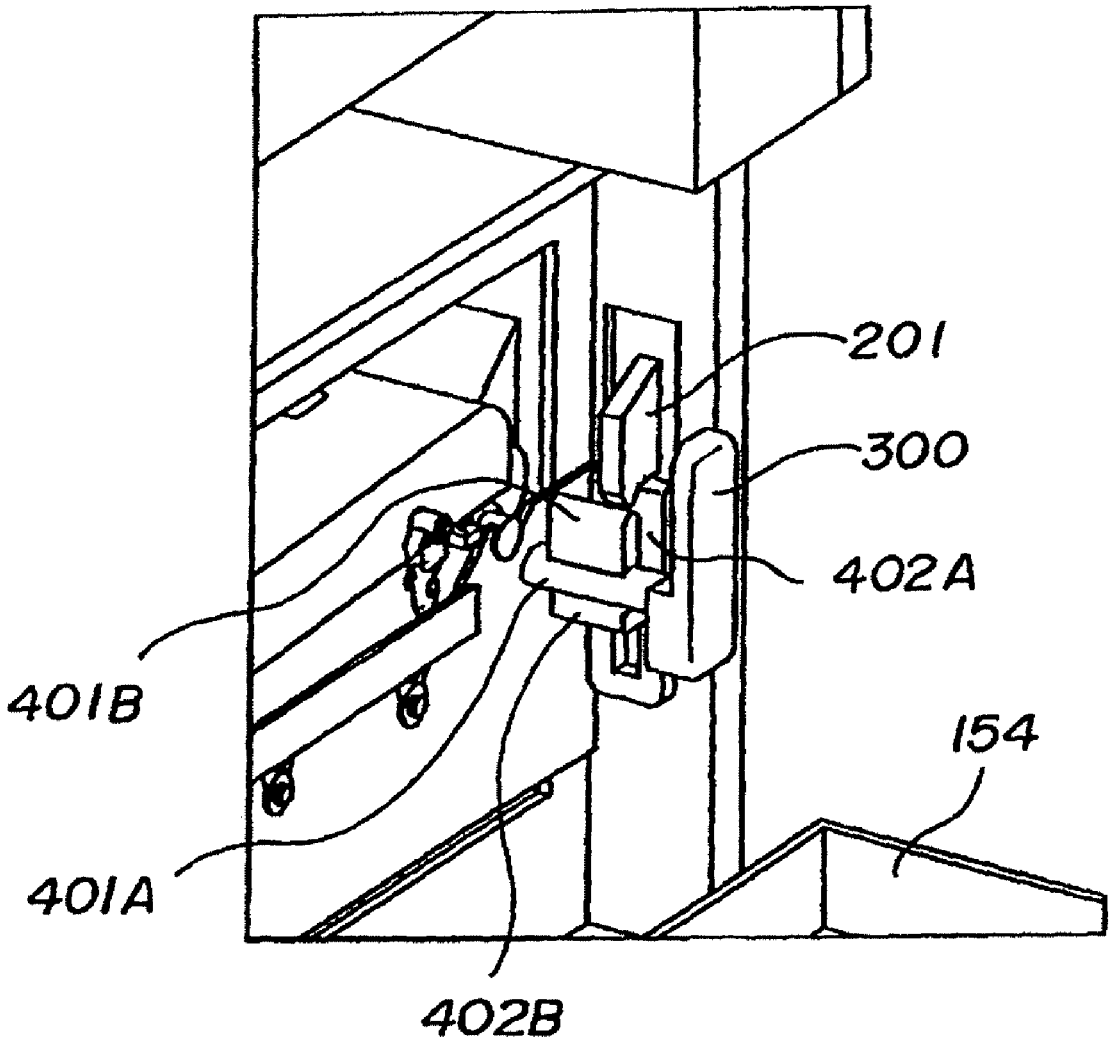
FIG. 8A illustrates an explanatory view of a unit attachment/detachment configuration in a second embodiment.
Figure 8B:
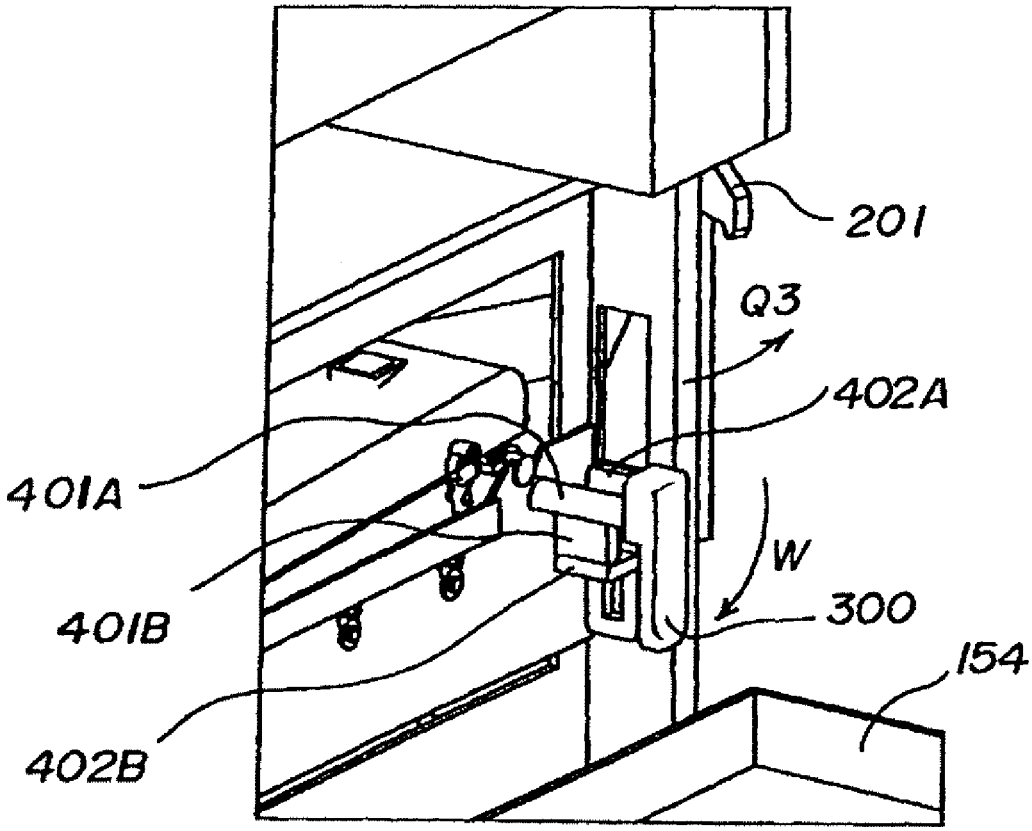
FIG. 8B illustrates an explanatory view of the unit attachment/detachment configuration in the second embodiment.

First, FIG. 8A is an enlarged view of the vicinity of the handle member 300 arranged on the right side facing the front surface of the apparatus main body. The handle member 300 is rotatably attached to the image creating main body case 129 by a handle support shaft 401A. A lever 401B is attached to the handle support shaft 401A. Similar to the first embodiment, the first locking means that engages the apparatus main body is arranged at the end (not shown) of the handle support shaft 301A, and the lock of the image creating unit is unlocked by rotating the handle support shaft with the handle member 300 in the clockwise direction. Similarly, a latch 201 is arranged at a position of accessing the vicinity of the handle through a square hole formed in the frame of the apparatus main body.

A stopper 402A is slidably arranged in the apparatus main body in the up and down direction at a position engaging the latch 201, and is biased upward by a spring (not shown) and the like. The stopper 402A engages the latch 201, that is, the conveyance door 155 is latched when the stopper 402A is at the upper side, and the latch 201 is released and the conveyance door 155 performs the opening operation when the stopper 402A is at the lower side. A lever hook 402B is further arranged at the end of the stopper 402A so as to engage the lever 401B. The procedures (2) and (3) described above will be described for the above configuration.

First, the handle member 300 is turned in the clockwise direction in FIG. 8A (direction of arrow W in FIG. 8B) to unlock the lock mechanism of the image creating unit 144 on the apparatus main body.

Next, the lever 401B is similarly rotated in the clockwise direction by rotating the handle member 300, thereby engaging with the lever hook 402B, and in consequence, the stopper 402A is pushed downward. The latch of the conveyance door 155 is thereby released, and the conveyance door 155 is rotated in the direction of the arrow Q3 of FIG. 7B by repulsive force of the pressure force of the secondary transfer roller 117. Since the secondary transfer roller 117 arranged facing the intermediate transfer belt 101 is arranged on the conveyance door 155, the opening operation of the conveyance door 155 becomes the pressure releasing operation of the intermediate transfer belt 101 and the secondary transfer roller 117.

Therefore, the lock mechanism of the image creating unit and the latch mechanism of the conveyance door are both arranged on the image creating unit side in the first embodiment, whereas the latch mechanism of the conveyance door is arranged on the main body side in the second embodiment. According to such configuration, the number of components increases, but a more reliable latch can be performed since the positioning precision of the latch mechanism and the conveyance door enhances.

Third Embodiment

An image forming apparatus according to the third embodiment will now be described with reference to FIG. 9. The basic configuration of the apparatus of the present embodiment is the same as the first embodiment described above, and thus redundant description will not be repeated, and characteristic configuration of the present embodiment will be described herein. The same reference numerals are denoted for members having the same function as the above-described embodiments.

Figure 9A:
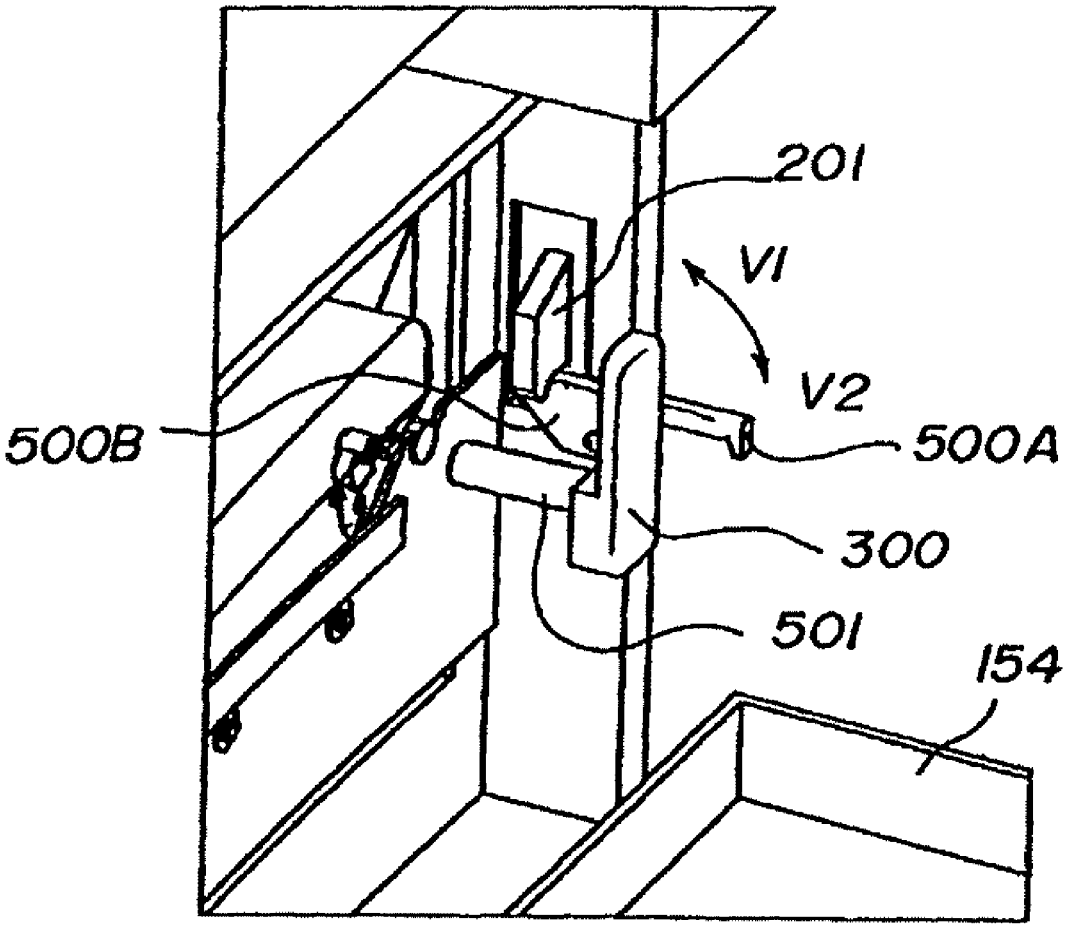
FIG. 9A illustrates an explanatory view of a unit attachment/detachment configuration in a third embodiment.

FIG. 9A is an enlarged view of the vicinity of the handle member 300 arranged on the right side facing the front side of the apparatus main body. The handle member 300 is rotatably attached to the image creating main body case 129 by a handle support shaft 501. Similar to the first embodiment, the locking portion that engages the apparatus main body is arranged at the end (not shown) of the handle support shaft 501, and the lock is unlocked when the handle support shaft is rotated with the handle member 300 in the clockwise direction. Similarly, a latch 201 is arranged at the end of the conveyance door 155 at a position of accessing the vicinity of the handle through a square hole formed in the frame of the apparatus main body.

Figure 9B:
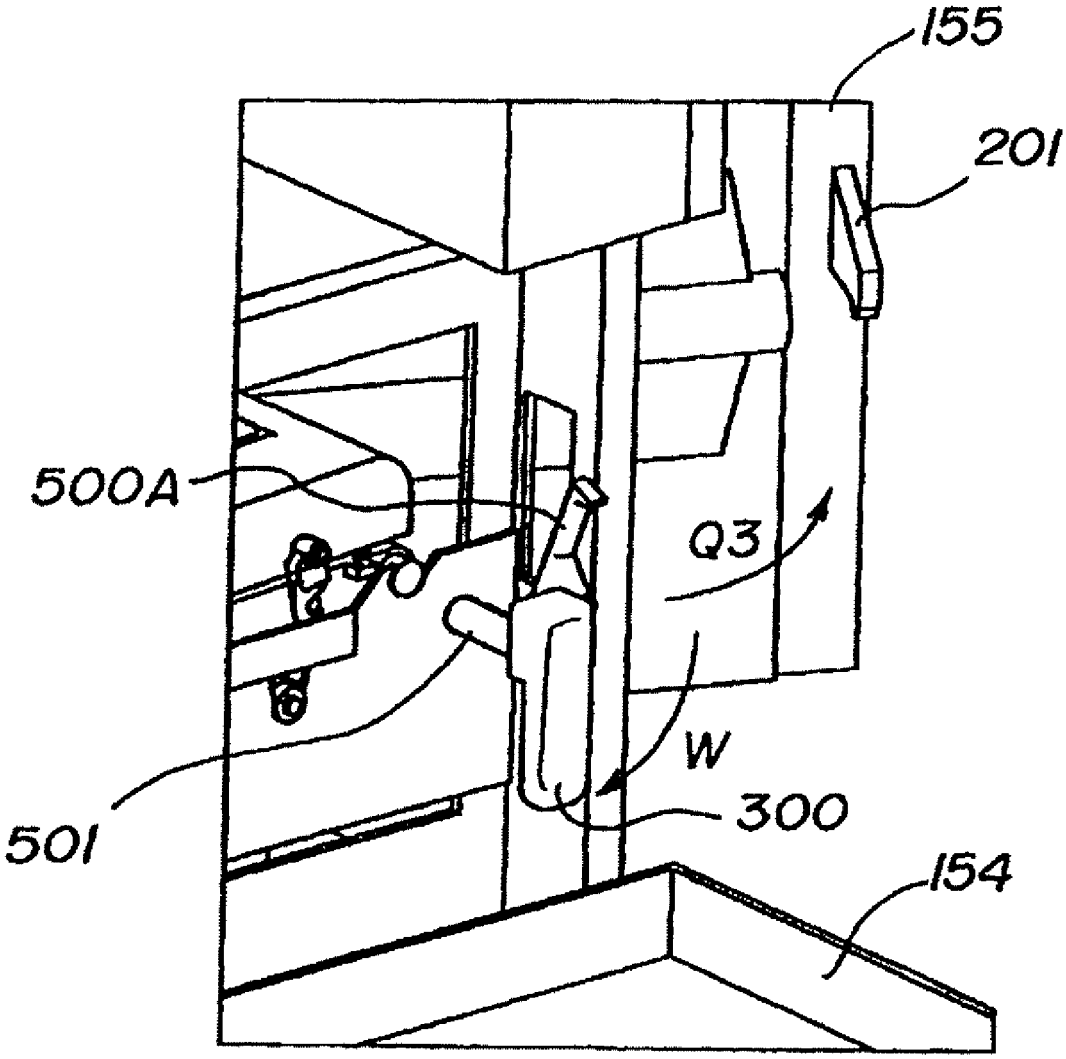
FIG. 9B illustrates an explanatory view of the unit attachment/detachment configuration in the third embodiment.
Figure 10:
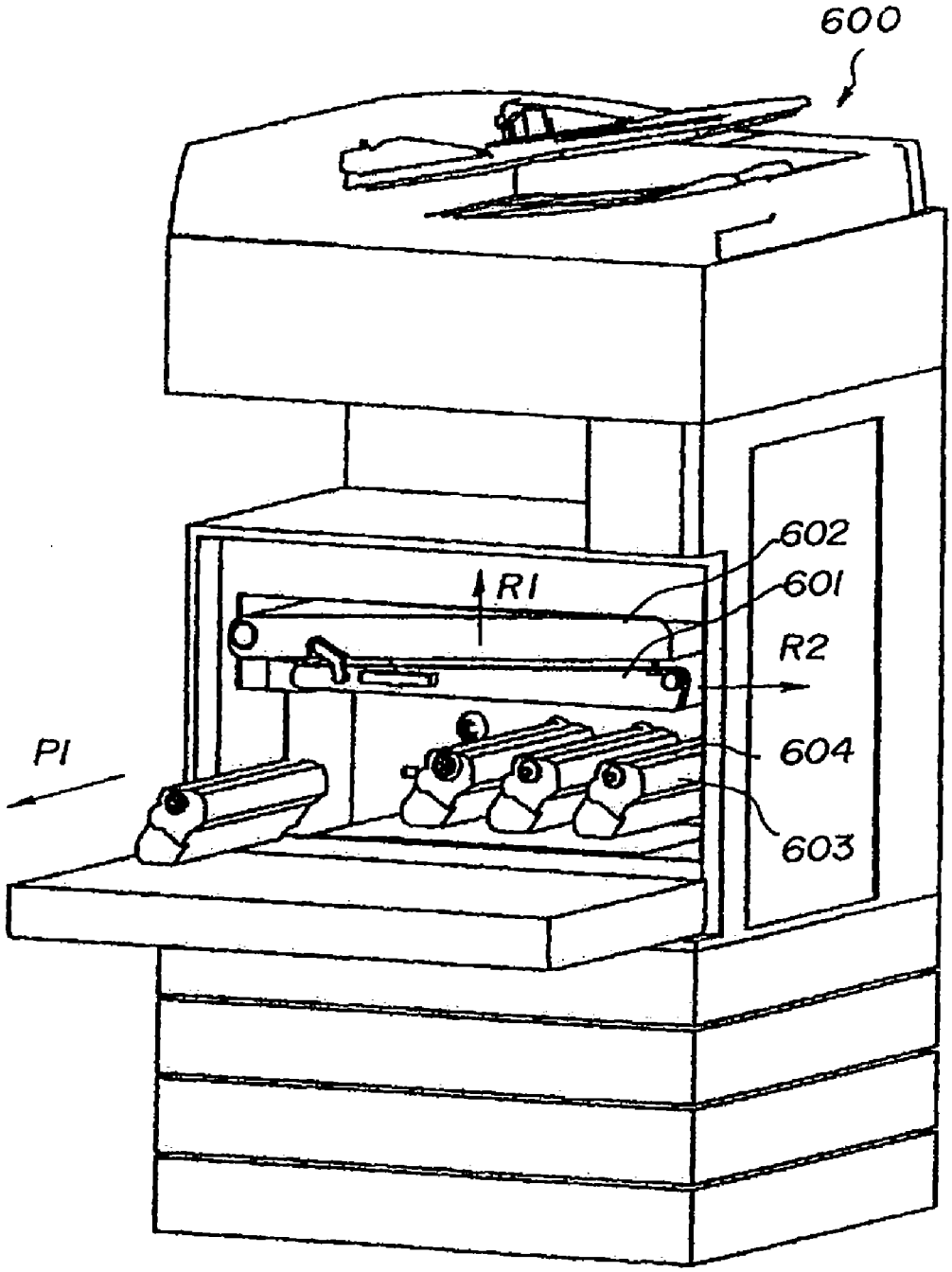
PRIOR ART FIG. 10
FIG. 10 illustrates an explanatory view of a configuration of attaching and detaching an image creating unit according to a first prior art example.
Figure 11:
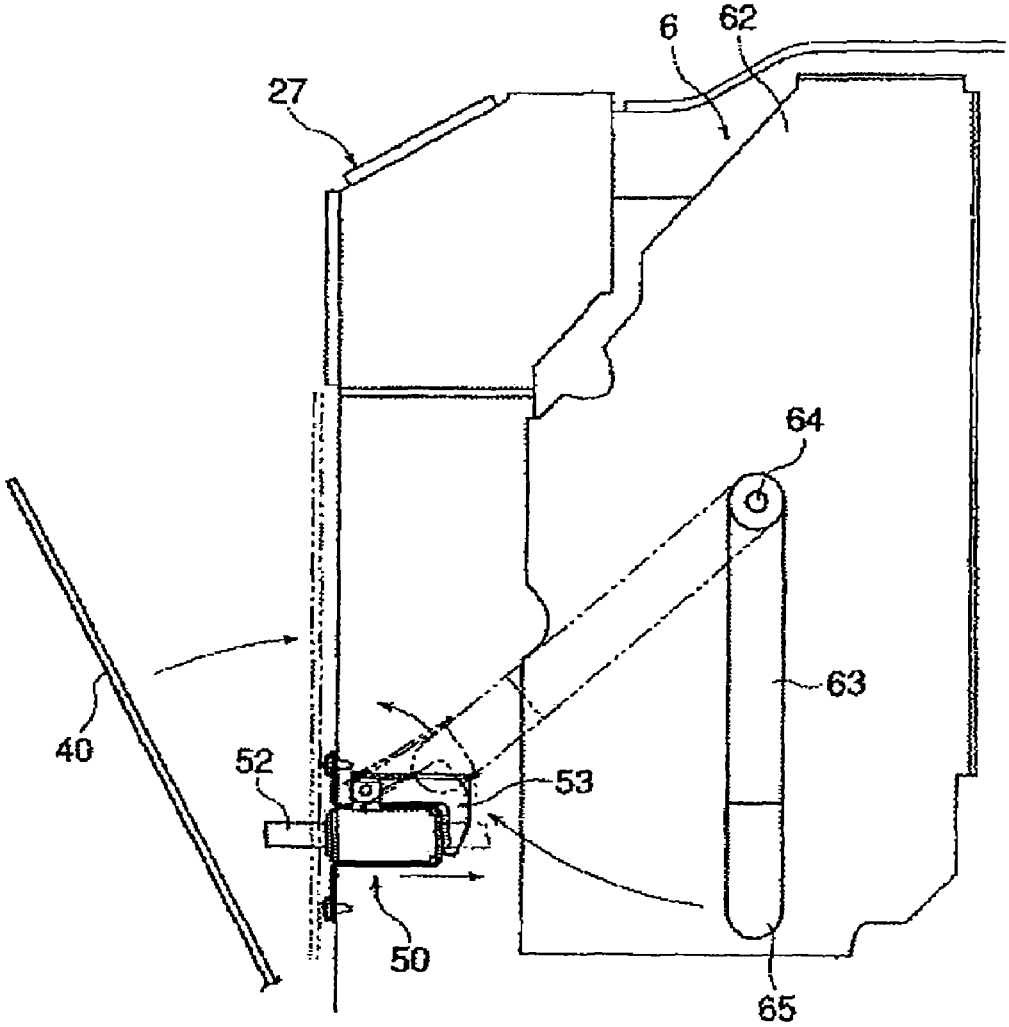
PRIOR ART FIG. 11
FIG. 11 illustrates a cross sectional view of one part of an image forming apparatus in a second prior art example.

A stopper 500B is rotatably arranged in the direction of the arrows V1, V2 shown in FIG. 9A at a position of engaging the latch 201 in the apparatus main body. The stopper 500B engages the latch 201, that is, the conveyance door 155 is latched when the stopper 500B is at position V2, and the latch 201 is released and the conveyance door 155 performs the opening operation when the stopper 500B is at position V1, as shown in FIG. 9B. An opening operation lever 500A is arranged at the end of the stopper 500B to operate the stopper. The above-described procedures (2) and (3) will now be described for the above configuration.

The handle member 300 is regulated by the opening operation lever 500A, and cannot be rotated in the clockwise direction in the state of FIG. 9A. Therefore, the opening operation lever 500A is rotated in the direction of the arrow V1 in the first operation procedure to release the latch 201 and opening the conveyance door 155. The handle member 300 that is now rotatable is rotated in the clockwise direction (direction of arrow W in FIG. 9B), so that the lock mechanism of the image creating unit 144 on the apparatus main body is released.

The pressure releasing operation on the intermediate transfer belt 101 and the unlocking operation of the image creating unit 144 are performed through the above operations. The difference between the present embodiment and the first and second embodiments described above is that the order of the unlocking operation and the pressure releasing operation of the secondary transfer roller in the operation procedures (above-described operations (2) and (3)) is reversed.

As described in detail above, the pressurizing/pressure releasing mechanism that is reliable and that is less likely to cause malfunction can be arranged without taking up size by adopting the configuration of the present embodiment. Moreover, advantages of enhancing the maintenance property and replacement property are obtained by facilitating the access to the drive transmitting portion.

Other Embodiments

A configuration of integrally sliding the intermediate transfer belt unit 115, the transfer frame 102, the process cartridges

103, and the image creating main body case 129 as the image creating unit 144 has been illustrated in the above embodiment. However, the unit merely needs to be a unit that includes the second image bearing member, and that in which only the intermediate transfer belt unit 115 is detachably attached may be used.

Only the transfer roller contacts the second image bearing member in the above example, but a configuration in which the conveyance roller which conveys the recording material may be arranged in the opening/closing member so that the conveyance roller contacts the second image bearing member.

Examples of the present invention have been described above, but the present invention is not particularly limited to the above examples, and various modifications can be made within the technical concept of the present invention.

CROSS-REFERENCE TO RELATED APPLICATION

This application claims the benefit of priority from the prior Japanese Patent Application No. 2006-135288 filed on May 15, 2006 the entire contents of which are incorporated by reference herein.

What is claimed is:

1. An image forming apparatus comprising:

an image bearing member bearing a toner image to be transferred to a recording material;

a unit including the image bearing member and capable of being pulled out from the image forming apparatus;

a transfer member which contacts the image bearing member and transfers the toner image on the image bearing member onto the recording material;

an opening/closing member including the transfer member and capable of being opened and closed with respect to the image forming apparatus;

a first locking means which locks the unit to the image forming apparatus; and a second locking means which locks the opening/closing member to the image forming apparatus in a closed state;

wherein the first locking means and the second locking means are coupled when the first locking means and the second locking means are locked, and the coupling of the first locking means and the second locking means are released in conjunction with the releasing operation of the first locking means; and wherein the unit is capable of being pulled in a direction different from a direction of opening the opening/closing member.

2. The image forming apparatus according to claim 1, wherein the second locking means holds the opening/closing member to the image forming apparatus and is coupled to one part of the first locking means in a closed state when the first locking means is at a position of locking the unit to the image forming apparatus.

3. The image forming apparatus according to claim 1, wherein the coupling of the first locking means and the second locking means is released when the first locking means is at a position of unlocking the unit with respect to the image forming apparatus.

4. The image forming apparatus according to claim 1, wherein the first locking means is a movement member which is operated when locking or unlocking the unit, the movement member including a coupling portion which fits with the second locking means to hold the opening/closing member to the image forming apparatus in a closed state.

5. The image forming apparatus according to claim 4, wherein the coupling portion moves when the movement member moves, thereby unlocking the locking of the opening/closing member to the image forming apparatus.

6. The image forming apparatus according to claim 1, wherein the opening/closing member is opened when the coupling of the first locking means and the second locking means is released.

7. The image forming apparatus according to claim 1, wherein the opening/closing member cannot be locked by closing the second locking means when the first locking means is unlocked.

8. The image forming apparatus according to claim 1, wherein the first locking means is a handle member and the second locking means is a hook which engages a part of the handle member.

9. The image forming apparatus according to claim 8, wherein the hook disengages from the part of the handle member as the handle member is rotated from a locked position to an unlocked position.

* * * * *